US007827859B2

(12) United States Patent
Pipchuk et al.

(10) Patent No.: US 7,827,859 B2
(45) **Date of Patent: *Nov. 9, 2010**

(54) APPARATUS AND METHODS FOR OBTAINING MEASUREMENTS BELOW BOTTOM SEALING ELEMENTS OF A STRADDLE TOOL

(75) Inventors: Douglas Pipchuk, Calgary (CA); Michael H. Kenison, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 49 days.

This patent is subject to a terminal disclaimer.

(21) Appl. No.: 11/751,359

(22) Filed: May 21, 2007

(65) Prior Publication Data

US 2008/0134775 A1 Jun. 12, 2008

Related U.S. Application Data

(60) Provisional application No. 60/869,614, filed on Dec. 12, 2006.

(51) Int. Cl.
*E21B 47/10* (2006.01)

(52) U.S. Cl. ..... 73/152.18

(58) Field of Classification Search ..... 73/152.18, 73/152.22, 152.05, 152.14
See application file for complete search history.

(56) References Cited

U.S. PATENT DOCUMENTS

| | | | | |
|---|---|---|---|---|
| 2,567,321 | A * | 9/1951 | Leo Courter | 166/145 |
| 3,420,095 | A * | 1/1969 | Meaux et al. | 73/40.5 R |
| 4,860,581 | A | 8/1989 | Zimmerman | 73/152.26 |
| 4,936,139 | A | 6/1990 | Zimmerman | 73/152.26 |
| 6,655,461 | B2 | 12/2003 | Eslinger | 166/305.1 |
| 2002/0066308 | A1 * | 6/2002 | Shapiro | 73/152.18 |
| 2004/0253734 | A1 * | 12/2004 | Firmin | 436/28 |
| 2006/0196660 | A1 * | 9/2006 | Patel | 166/250.15 |
| 2008/0041594 | A1 * | 2/2008 | Boles et al. | 166/305.1 |

* cited by examiner

*Primary Examiner*—Hezron Williams
*Assistant Examiner*—Tamiko D Bellamy
(74) *Attorney, Agent, or Firm*—Rodney Warfford; Michael L. Flynn; Robin Nava

(57) ABSTRACT

The present invention provides methods and apparatus for obtaining downhole well pressure during wellbore operations. One method comprises providing a well intervention tool comprising a straddle sealing assembly having upper and lower annulus sealing elements and a fluid injection port positioned therebetween, the well intervention tool comprising a fluid injection bore having positioned therein a pressure measurement tool; placing the tool in straddle position about a wellbore region to be intervened, with the pressure measurement tool fluidly connected to a wellbore region below the lower annulus sealing element; and performing the wellbore intervention operation while communicating fluid from below the lower annulus sealing element to the pressure measurement tool, thus obtaining a pressure measurement below the lower annulus sealing element during the wellbore intervention operation. This abstract will not be used to interpret or limit the scope or meaning of the claims.

25 Claims, 2 Drawing Sheets

APPARATUS AND METHODS FOR OBTAINING MEASUREMENTS BELOW BOTTOM SEALING ELEMENTS OF A STRADDLE TOOL

CROSS-REFERENCE TO RELATED APPLICATIONS

The present application claims priority under 35 U.S.C. §119(e) to U.S. Provisional Application Ser. No. 60/869,614, filed Dec. 12, 2006, incorporated by reference herein in its entirety.

BACKGROUND OF THE INVENTION

1. Field of Invention

The present invention relates generally to methods and apparatus for stimulating hydrocarbon-bearing formations, i.e., to increase the production of hydrocarbon oil and/or gas from the formation, and more particularly to methods and apparatus for obtaining pressure below sealing elements in a wellbore completion.

2. Related Art

Hydrocarbons (oil, natural gas, etc.) are obtained from a subterranean geologic formation (i.e., a "reservoir") by drilling a well that penetrates the hydrocarbon-bearing formation and thus causing a pressure gradient that forces the fluid to flow from the reservoir to the well. Often, well production is limited by poor permeability either due to naturally tight formations or due to formation damages typically arising from prior well treatment, such as drilling.

To increase the net permeability of a reservoir, it is common to perform a well stimulation treatment. A common stimulation technique consists of injecting an acid that reacts with and dissolves the formation damage or a portion of the formation thereby creating alternative flow paths for the hydrocarbons to migrate through the formation to the well. This technique known as acidizing (or more generally as matrix stimulation) may eventually be associated with fracturing if the injection rate and pressure is enough to induce the formation of a fracture in the reservoir.

In stimulation of oil and gas wells there is a need to acquire downhole information in real time to optimize the treatment of the well. This is especially true when compressible fluids, such as nitrogen or nitrified liquid, are pumped, since surface measurements may offer an inaccurate and delayed picture of what is happening downhole.

Current technologies enable acquisition of downhole measurements in real time during a job with a straddle packer. However, no tool on the market today provides measurements from below the bottom packer/element. A pressure measurement in this location, for instance, has the potential to add tremendous value to the operation, as it would indicate cross-flow between zones or leakage across the element.

Tubel Technologies, Inc., has a tool to take bottomhole pressure and temperature above the elements and transmit data acoustically. However, there is currently no known method and apparatus for taking measurements from below the bottom element, or for transmitting this pressure in real time to the surface.

Published Patent Applications US20050263281, WO2005116388, US20050236161 and WO2005103437 describe technology to communicate between downhole sensors and the surface to enable real time decision making based on accurate (0.01% accuracy) bottomhole pressure and temperature (1% accuracy) gauges, however, none of these references describe sensing pressure below a bottom sealing element of a packer and communicating this information to the surface, nor so they describe sensing pressure below a bottom sealing element of a packer during a well stimulation treatment and communicating this information to the surface, or using this information in real-time to make decisions during the stimulation, for example, to increase or decrease flow of a stimulation fluid.

From the above it is evident that there is a need in the art for new methods and new tools to measure pressure in real-time below a bottom packer element of a straddle packer, or below other flow sealing elements (such as chemical barriers) sealing the region being stimulated, and using this information in real-time or later.

SUMMARY OF THE INVENTION

In accordance with the present invention, methods and systems (also referred to herein as tools or downhole tools) for practicing the methods are described that reduce or overcome problems in previously known methods and systems. Methods and systems of the invention allow determination of pressure below a bottom sealing element in real time during well stimulation and other intervention operations in hydrocarbon-bearing reservoirs.

A first aspect of the invention are methods for obtaining downhole well pressure during one or more wellbore intervention operations, one method comprising:

(a) providing a well intervention tool comprising a straddle sealing assembly having upper and lower annulus sealing elements and a fluid injection port positioned therebetween, the well intervention tool comprising a fluid injection bore having positioned therein a pressure measurement tool;

(b) placing the tool in straddle position about a wellbore region to be intervened, with the pressure measurement tool fluidly connected to a wellbore region below the lower annulus sealing element; and (c) performing the wellbore intervention operation while communicating fluid from below the lower annulus sealing element to the pressure measurement tool, thus obtaining a pressure measurement below the lower annulus sealing element during the wellbore intervention operation.

Methods within the invention may further comprise monitoring the movement of a treating fluid or other fluid in a reservoir by the pressure measurement, and optionally providing one or more other sensors for measurement of parameters such as composition, temperature, salinity, resistivity, optical properties, determining differential flow by monitoring, programming, modifying, and/or measuring one or more parameters selected from temperature, pressure, rotation of a spinner, measurement of the Hall effect, volume of fluids pumped, fluid flow rates, fluid paths (annulus, tubing or both), acidity (pH), fluid composition (acid, diverter, brine, solvent, abrasive, and the like), conductance, resistance, turbidity, color, viscosity, specific gravity, density, combinations thereof and the like, wherein the sensors are disposed on or in the tool. Methods within the invention may be used during injection of inert as well as reactive fluids. Certain methods within the invention include adjusting the pressure, injection flow rate, temperature, and/or composition of a treating fluid in response to the measured pressure and other optional measurements made, and methods wherein the adjusting step is made in real time. Other methods within the invention include those wherein the tool is attached to the end of coiled tubing, methods wherein the coiled tubing extends substantially along the full length of the well, and methods wherein fluids are injected from different flow paths. Yet other methods of the invention are those wherein pressure, and optionally one or more other parameters are measured at a plurality of points upstream and downstream of the of the fluid injection point. One advantage of systems and methods of the invention is that fluid volumes and time spent on location performing the well intervention operation may be optimized. By determining more precisely the placement of the treatment fluid(s), which may or may not include solids, for example slurries, and whether or not the fluids are leaking past a straddle packer sealing element, the inventive methods may comprise controlling the injection via one or more flow control devices and/or fluid hydraulic techniques to divert and/or place the fluid into a desired location that is determined by the objectives of the operation.

Certain methods of the invention may employ plot curve interpretation algorithms for bottomhole pressure to identify regions in cased or open-hole wells that are readily accepting fluids (i.e., flow is non-zero), when any of the fluid types, for example acid, brine, foams, and the like, are being pumped, using a tubular during a matrix treatment. These methods comprise generating diagnostic plots of temperature derivative with respect to time and coiled tubing depth, t*dT/dt and D*dT/dD vs. time (T=temperature, t=time, D=CT depth), optionally as the data is obtained in real time or non-real-time, optionally "smoothed" to reduce any "noise" in the data (if necessary), and then used to interpret the shape of the curve to determine "active" regions of the reservoir that are readily accepting, marginally accepting, or rejecting the injected fluids. Methods of this type are further described in assignee's co-pending published application Ser. No. 11/750,068 incorporated herein by reference (SLB 25.0409).

In all methods and systems of the invention, while the discussion primarily focuses on use of tools attached to and conveyed by coiled tubing (CT), the tubular may be selected from coiled tubing and sectioned pipe wherein the sections may be joined by any means (welded, screwed, flanged, and the like), and combinations thereof.

Exemplary methods of the invention include evaluating, modifying, and/or programming the well intervention in real-time to ensure treatment fluid is efficiently diverted in a reservoir.

Methods in accordance with the invention may be used prior to, during and post treatment, and any combination thereof, including during all of these.

Another aspect of the invention are apparatus, one apparatus of the invention comprising a well intervention tool comprising:

(a) a straddle sealing assembly comprising upper and lower annulus sealing elements supported by a body, the body comprising i) a longitudinal fluid injection bore having positioned therein a pressure measurement tool, and ii) a fluid injection port positioned in the body between the sealing elements;

(b) a fluid connection connecting the pressure measurement tool fluidly with a wellbore region below the lower annulus sealing element, thus allowing obtaining of a pressure measurement of wellbore fluids below the lower annulus sealing element during a wellbore intervention operation.

Methods and systems of the invention will become more apparent upon review of the brief description of the drawings, the detailed description of the invention, and the claims that follow.

BRIEF DESCRIPTION OF THE DRAWINGS

The manner in which the objectives of the invention and other desirable characteristics may be obtained is explained in the following description and attached drawings in which.

Figure 1:
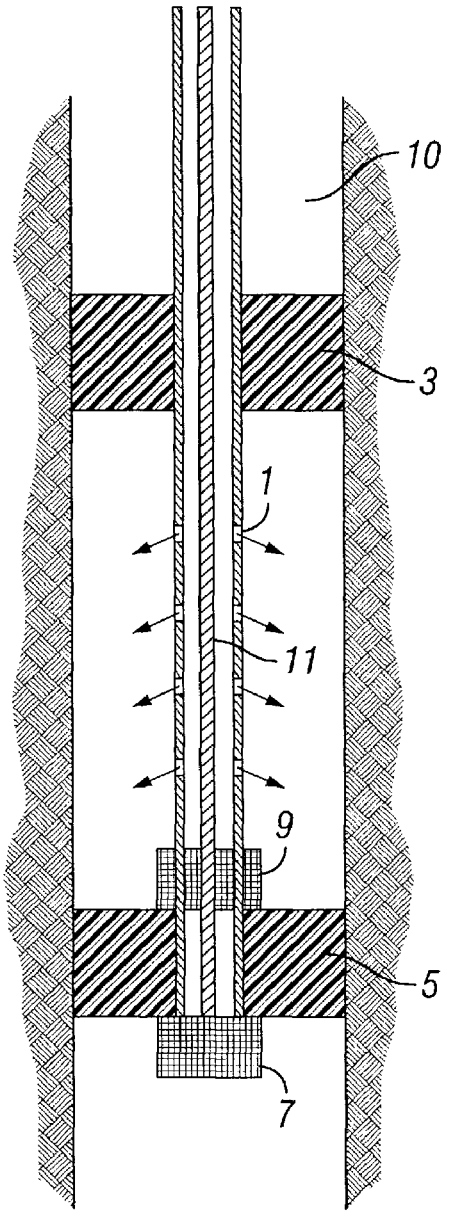
FIG. 1 (Prior Art)
FIG. 1 is a side cross-sectional view of a prior art apparatus able to measure pressure between sealing elements of a straddle packer but not capable of providing pressure measurement of wellbore fluids below the lower sealing element of the straddle packer.

It is to be noted, however, that the appended drawings are not to scale and illustrate only typical embodiments of this invention, and are therefore not to be considered limiting of its scope, for the invention may admit to other equally effective embodiments.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

As used herein "oilfield" is a generic term including any hydrocarbon-bearing geologic formation, or formation thought to include hydrocarbons, including onshore and offshore. As used herein when discussing fluid flow, the terms "divert", "diverting", and "diversion" mean changing the direction, the location, the magnitude or all of these of all or a portion of a flowing fluid. A "wellbore" may be any type of well, including, but not limited to, a producing well, a non-producing well, an experimental well, and exploratory well, and the like. Wellbores may be vertical, horizontal, some angle between vertical and horizontal, and combinations thereof, for example a vertical well with a non-vertical component.

FIG. 1 is a recreation of FIG. 6 from assignee's published US patent application 20050263281, wherein there is shown a schematic illustration of matrix stimulation performed using a prior art coiled tubing apparatus comprising a fiber optic tether wherein a well treatment fluid is introduced into a wellbore 10 through coiled tubing 1. The treatment fluid may be introduced using one of the various tools known in the art for that purpose, e.g., nozzles attached to the coiled tubing. In the example of FIG. 1, the fluid that is introduced into the wellbore 10 is prevented from escaping from the treatment zone by the barriers 3 and 5. The barriers 3 and 5 may be some mechanical barrier such as an inflatable packer or a chemical division such as a pad or a foam barrier.

It is preferred in matrix stimulation operations to place the treatment fluid in the proper zone(s) in the wellbore 10. In a preferred embodiment, an optical sensor 7 capable of determining depth may be used to determine the location of the downhole apparatus providing the matrix stimulation fluid. Optical sensor 7 is connected to fiber optic tether 11 for communicating the location in the wellbore 10 to the surface control equipment to allow an operator to activate the introduction of the treatment fluid at the optimal location.

The present invention permits real time monitoring of parameters such bottom-hole pressure, bottom-hole temperature, bottom-hole pH, amount of precipitate being formed by the interaction of the treatment fluids and the formation, and fluid temperature, each of which are useful for monitoring the success of a matrix stimulation operation. A sensor 9 for measuring such parameters (e.g., a sensor for measuring pressure, temperature, or pH or for detecting precipitate formation) may be connected to fiber optic tether 11 disposed within coiled tubing 1 and to the fiber optic tether 11. The measurements may then be communicated to the surface equipment over fiber optic tether 11.

Real-time measurement of bottomhole pressure, for example, is useful to monitor and evaluate the formation skin, thereby permitting optimization of the injection rate of stimulation fluid, or permitting the concentration or relative proportions of mixing fluid or relative proportions of mixing fluids and solid chemicals to be adjusted. When the coiled tubing is in motion, measurements of real-time bottom-hole pressure may be adjusted by subtracting off swab and surge effects to take into account the motion of the coiled tubing. Another use of real-time bottom hole pressure is to maintain borehole pressure from fluid pumping below a desired threshold level. During matrix stimulation for example, it is important to contact the wellbore surface with treatment fluid. If the wellbore pressure is too high, then formation will fracture and the treatment fluid will undesirably flow into the fracture. The ability to measure bottom hole pressure in real time particularly is useful when treatment fluids are foamed. When pumping non-foamed fluids, bottomhole pressure sometimes may be determined from surface measurements by assuming certain formulas for friction loss down the wellbore, but such methods are not well established for use with foamed fluids. As maybe seen, however, the prior art apparatus does not enable measurement of wellbore fluid pressure below lower sealing element 5.

Method and apparatus of the present invention enable downhole well pressure to be obtained in real time. The pressure may be measured below the bottom sealing element of a straddle sealing assembly during wellbore intervention operations. The pressure could be used to determine the condition of the well below the bottom sealing element. The pressure below the sealing element can be used for determining the integrity of the seal of the element to the casing and/or to determine the integrity of the seal outside the casing.

Figure 2:
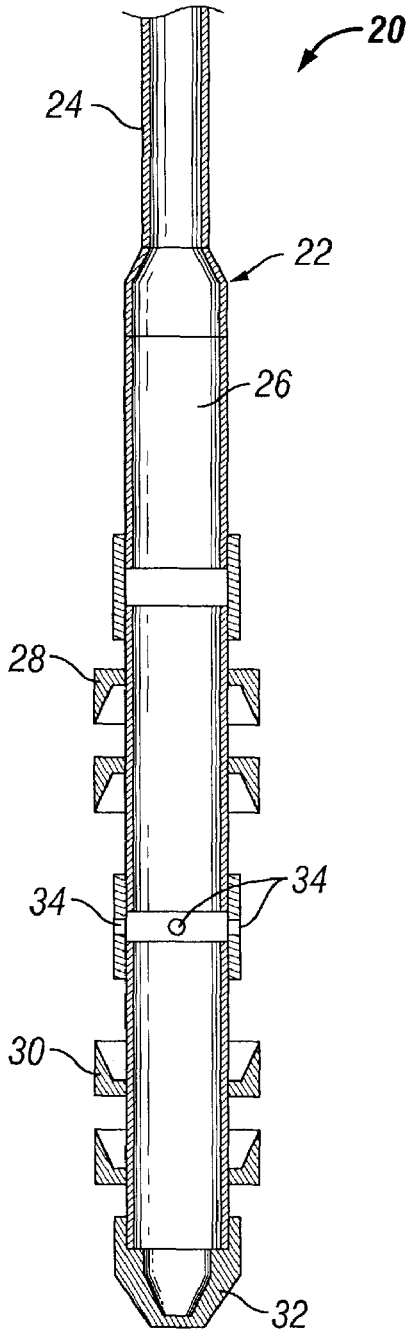
FIG. 2 (Prior Art)
FIG. 2 is a side cross-sectional view of a prior art high-rate frac tool apparatus able to inject a well treatment fluid or other fluid into a region of a formation, including a section of coiled tubing, a coiled tubing connector, and a straddle packer.

FIG. 2 illustrates in side cross-section a typical prior art tool 20 used for injecting high rate fluids between sealing elements in one type of well intervention. Tool 20 comprises a connector 22 for connecting to coiled tubing 24 or other oilfield tubular. Tool 20 includes a bore 26 having a large ID, and upper and lower seals, 28, 30, between which is disposed one or more fluid injection ports 34. Fluid injection ports may or may not be evenly spaced around the tool, and may or may not all be placed at the same location (level) on the tool, as long as they are between sealing elements 28, 30. There is a bullnose 32 at the bottom of the tool to prevent fluid communication. It may be very difficult to determine what is happening downhole with this type of tool from surface measurements. For instance, large margins of error are introduced into the measurements if the fluid is compressible, or comprises a compressible fluid, such as nitrogen.

Figure 3:
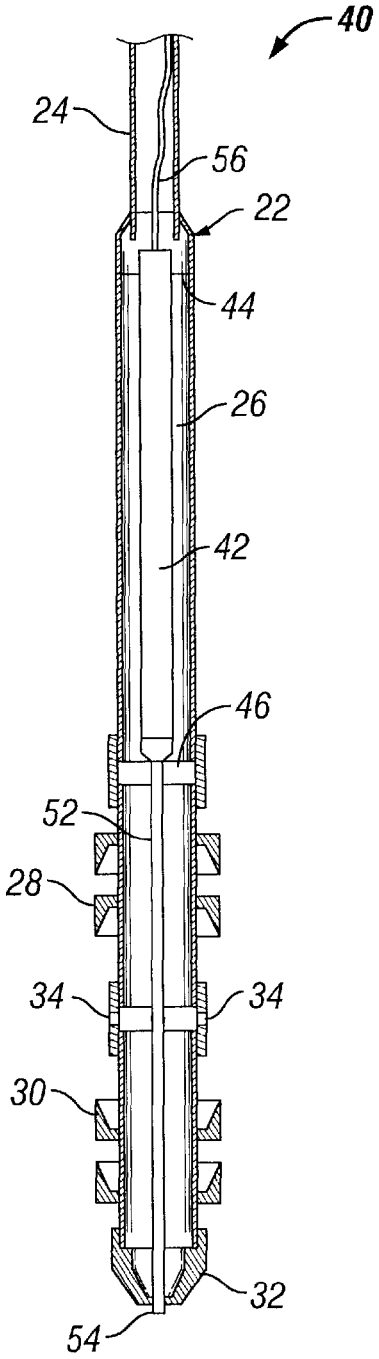
FIGS. 3 and 4 are side cross-sectional views of two embodiments of apparatus of the invention enabling pressure measurement below the lower seal.

A first embodiment 40 of the present invention is illustrated in side cross-section FIG. 3. Due to the large ID 26 of the straddle tool, a measurement tool 42 is placed inside the straddle tool housing, and may be supported and centered therein by members 44, 46, although centering is not essential. A through hole is added to bullnose 32, allowing an end 54 of a tube 52 to be run from below the lower seal 30 to inside measurement tool 42. Measurement tool 42 may now measure treating pressure, bottomhole temperature, depth via casing collar location, and other parameters as discussed herein, as well as pressure below the lower seal. The real-time pressure measurement below lower seal 30 is unique to this invention, and adds much value over the state of the art. By measuring the pressure below the lower seal, the operator may determine (through a communication connection) if lower seal 30 is leaking, and also if there is cross-flow from one reservoir zone to another. This has the potential to change how intervention jobs are performed in real time and optimize the treatment. This data may be evaluated realtime to determine if another treatment of the zone is necessary.

Figure 4:
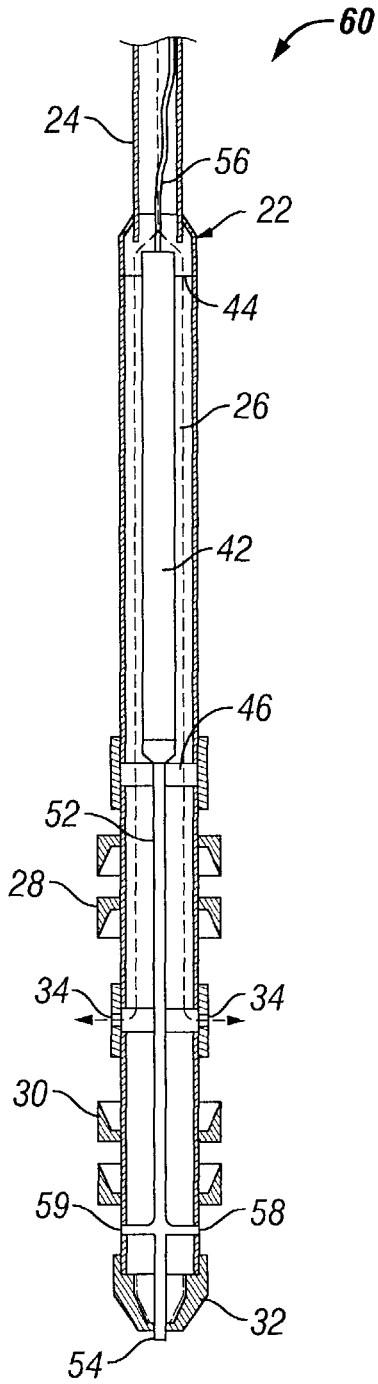

FIG. 4 illustrates another embodiment 60 within the invention, which differs from embodiment 40 illustrated in FIG. 3 by inclusion of more fluid connections (58, 59) in the lower end of the tool for fluid connection to measuring tool 42. Another alternative, not illustrated, may be to provide more than one tube 52 for fluidly connecting the wellbore region below lower sealing element 30 with measuring tool 42. The dotted lines in FIG. 4 illustrate the path of fluid as it would be pumped from the surface into the reservoir. The fluid may be liquid, gas, foam, gel, or combination thereof, and may comprise solids in certain embodiments, and may comprise one or more compositions and combinations of components. Note that measurements other than pressure may be ported to measurement tool 42 from below lower seal 30 using any embodiment of the invention.

Apparatus and methods of the invention may include surface/tool communication through one or more communication links 56, including but not limited to hard wire, optical fiber, radio, or microwave transmission. One suitable fiber optic connection are the fiber optic tethers described in assignee's published US patent application number 20050236161, incorporated herein by reference. The tethers described therein comprise a duct in a fiber optic tube, wherein the tube provides stiffness, are resistant to fluids encountered in oilfield applications, and are rated to withstand the high temperature and high pressure conditions found in some wellbore environments. Typically the duct in the fiber optic tube is a metallic material, and in some embodiments comprises metal materials such as Inconel (RTM), stainless steel, or Hastelloy (RTM). While fiber optic tubes manufactured by any method may be used in the present invention, laser welded fiber optic tubes may be particularly effective as the heat affected zone generated by laser welding is normally less than that generated by other methods such as TIG welding, thus reducing the possibility of damage to the optical fiber during welding.

While the dimensions of such fiber optic tubes are small (for example the diameter of such products commercially available from K-Tube, Inc of California, U.S.A. range from 0.5 mm to 3.5 mm), they have sufficient inner void space to accommodate multiple optical fibers. The small size of such fiber optic tubes is particularly useful in the present invention as they do not significantly deduct from the capacity of a tubular to accommodate fluids or create obstacles to other devices or equipment to be deployed in or through the tubular.

In some embodiments, the fiber optic tube may comprise a duct with an outer diameter of 0.071 inches to 0.125 inches (3.175 mm) formed around one or more optical fibers. In certain embodiments, standard optical fibers may be used, and duct is no more than 0.020 inches (0.508 mm) thick. While the diameter of the optical fibers, the protective tube, and the thickness of the protective tube given here are exemplary, it is noteworthy that the inner diameter of the protective tube may be larger than needed for a close packing of the optical fibers.

In some embodiments of the present invention, the fiber optic tube 56 may comprise multiple optical fibers may be disposed in a duct. In some applications, a particular downhole apparatus may have its own designated optical fiber, or each of a group of apparatus may have their own designated optical fiber within the fiber optic tube. In other applications, a series of apparatus may use a single optical fiber.

Typical configurations for wellbore operations using coiled tubing may be suitable for the present in invention as well. Surface handling equipment may include an injector system on supports, a coiled tubing reel assembly on reel stand, flat, trailer, truck or other such device. In known manner the tubing may be deployed into or pulled out of the well using an injector head. The equipment further may include a levelwind mechanism for guiding the coiled tubing on and off the reel. The coiled tubing typically passes over a tubing guide arch which provides a bending radius for moving the tubing into a vertical orientation for injection through wellhead devices into the wellbore. The tubing passes from the tubing guide arch into an injector head that grippingly engages the tubing and pushes it into the well. A stripper assembly under the injector maintains a dynamic and static seal around the tubing to hold well pressure within the well as the tubing passes into the wellhead devices under well pressure. The coiled tubing then typically moves through a blowout preventer (BOP) stack, a flow tee and wellhead master valve or tree valve. When the coiled tubing disposed on the coiled tubing reel is deployed into or retrieved from a borehole, the coiled tubing reel rotates.

A fiber optic tube may be inserted into the coiled tubing through any variety of means. One embodiment comprises attaching a hose to the reel to the other end of which hose is attached a Y-joint. In this configuration, the fiber optic tube may be introduced into one leg of the Y and fluid pumped into the other leg. The drag force of the fluid on fiber optic tube then propels the tube down the hose and into the reel. It has been found that wherein the outer diameter of the tether is less than 0.125 inches (3.175 mm), a pump rate as low as 1-5 barrels per minute (2.65-13.25 liters per second) is sufficient to propel the tether the full length of the coiled tubing even while it is spooled on the reel In methods and apparatus of the present invention, a fluid, such as gas or water, may be used to propel a fiber optic tube 56 in a tubular 24. Typically, fiber optic tube 56 is disposed in an unrestrained manner in the pumped fluid. As the fluid is pumped into the tubular, the fiber optic tube is permitted to self-locate in the tubular without the use of external apparatus such as pigs for conveyance or placement or restricting anchors. In particular embodiments, the fluid is pumped and the fiber optic tube or tubes are deployed into coiled tubing while the coiled tubing is configured in a spooled state on a reel. These embodiments provide logistical advantages as the fiber optic tube or tubes can be deployed into the coiled tubing at a manufacturing plant or other location remote from a well site. Thus the optical fiber equipped tubing may be transported and field-deployed as a single apparatus, thereby reducing costs and simplifying operations. While still on the reel the fiber optic tube 56 may then be connected to the measuring tool 42. Alternatively, in certain embodiment it may be possible to convey the fiber optic tube 56 and measuring tool 42 together through the coiled tubing.

The optical fiber equipped tubing may be used in conventional wellbore operations such as providing a stimulation fluid to a subterranean formation through coiled tubing. One advantage of the present invention is that fiber optic tube 56 tolerates exposure to various well treatment fluids that may be pumped into the coiled tubing; in particular, the fiber optic tube or tubes can withstand abrasion by proppant or sand and exposure to corrosive fluids such as acids. Preferably the fiber optic tube is configured as a round tube having a smooth outer diameter, this configuration providing less opportunity for degradation and thus a longer useful life for the fiber optic tube.

The optical fiber equipped tubing and pressure measuring tools of the present invention is useful to perform a variety of wellbore operations including determining a plurality of wellbore properties and transmitting information from the wellbore. Determining includes, by way of example and not limitation, sensing using the optical fiber, sensing using a separate sensor, locating by a downhole apparatus, and confirming a configuration by a downhole apparatus. The optical fiber equipped tubing and measuring tools of the present invention may further comprise sensors such as fiber optic temperature and pressure sensors or electrical sensors coupled with electro-optical converters, disposed in a wellbore and linked to the surface via a fiber optic tube 56. Wellbore conditions that are sensed may be transmitted via fiber optic tube 56. Data sensed by electrical sensors may be converted to analog or digital optical signals using pure digital or wavelength, intensity or polarization modulation and then provided to the optical fiber or fibers in fiber optic tube 56. Alternatively, an optical fiber may sense some properties directly, for example when an optical fiber serves as a distributed temperature sensor, or when an optical fiber comprises Fiber-Bragg grating and directly senses strain, stress, stretch, or pressure.

The information from the sensors or the property information sensed by optical fiber may be communicated to the surface via communication link 56, which may be a fiber optic tube. Similarly, signals or commands may be transmitted from the surface to a downhole sensor or apparatus via fiber optic tube 56. In one embodiment of this invention, the surface communication includes a wireless telemetry link such as described in U.S. patent application Ser. No. 10/926,522, which is incorporated herein in its entirety by reference. In a further embodiment, the wireless telemetry apparatus may be mounted to the reel so that the optical signals can be transmitted while the reel is rotating without the need of a complicated optical collector apparatus. In yet a further embodiment, the wireless apparatus mounted to the reel may include additional optical connectors so that surface optical cables can be attached when the reel is not rotating.

It is to be appreciated that the embodiments of the invention described herein are given by way of example only, and that modifications and additional components can be provided to enhance the performance of the apparatus without deviating from the overall nature of the invention disclosed herein.

Methods in accordance with the invention may be used prior to, during and post treatment, and any combination thereof, including during all of these. Using one or more methods within the invention prior to reservoir treatment will allow estimation of formation damage in each layer of the reservoir from measurements of injection of an inert fluid, such as brine, along some or all of the entire length of the wellbore. The bottomhole pressure, and optionally other data, gathered during the injection test can be interpreted in real time by the method proposed and "zones of interest" can be identified.

Use of one or more methods within the present invention during a wellbore intervention operation will allow monitoring and optimization of the treatment in real time. The data may be transmitted to the surface (such as, by a stream of optical signals) and may be displayed on a computer screen, personal digital assistant, cellular phone, or other electronic device for real time interpretation. Placement of fluids in the formation may be optimized in real time by the use of diversion agents such as foam, inflatable open hole packers, fibers, and the like, and combinations thereof, to divert the stimulation where desired to potential zones. For example, if one finds that a certain reservoir layer is not being treated the injection rate of the fluids or the diverter volume or type may be changed or adjusted to divert the treating fluids to that layer.

Post treatment use of one or more methods within the present invention may allow evaluation of the effectiveness of the treatment by monitoring the injection of an inert fluid (such as brine used for post flush) to evaluate the stimulation achieved in each zone. Alternatively the entire data set may be recorded and analyzed post treatment (such as when telemetry equipment is not available).

In exemplary embodiments, the sensor measurements, realtime data acquisition, interpretation software and command/control algorithms may be employed to ensure effective fluid diversion, for example, command and control may be performed via preprogrammed algorithms with just a signal sent to the surface that the command and control has taken place, the control performed via controlling placement of the injection fluid into the reservoir and wellbore. In other exemplary embodiments, the ability to make qualitative measurements that may be interpreted realtime during a pumping service on coiled tubing or jointed pipe is an advantage. Apparatus and methods of the invention may include realtime indication of fluid movement (diversion) out the downhole end of the tubular, which may include down the completion, up the annulus, and in the reservoir. Two or more flow meters, for example electromagnetic flow meters, or thermally active sensors that are spaced apart from the point of injection at the end of the tubular may be employed. Other inventive methods and apparatus may comprise two identical diversion measurements spaced apart from each other and enough distance above the fluid injection port at the end or above the measurement devices, to measure the difference in the flow each sensor measures as compared to the known flow through the inside of the tubular (as measured at the surface).

The inventive methods and apparatus may employ multiple sensors that are strategically positioned and take multiple measurements, and may be adapted for flow measurement in coiled tubing, drill pipe, or any other oilfield tubular. Treatment fluids, which may be liquid or gaseous, or combination thereof, and/or combinations of fluids and solids (for example slurries) may be used in stimulation methods, methods to provide conformance, methods to isolate a reservoir for enhanced production or isolation (non-production), or combination of these methods. Data gathered may either be used in a "program" mode downhole; alternatively, or in addition, surface data acquisition may be used to make real time "action" decisions for the operator to act on by means of surface and downhole parameter control. Fiber optic telemetry may be used to relay information such as, but not limited to, pressure, temperature, casing collar location (CCL), and other information uphole.

The inventive methods and apparatus may be employed in any type of geologic formation, for example, but not limited to, reservoirs in carbonate and sandstone formations, and may be used to optimize the placement of treatment fluids, for example, to maximize wellbore coverage and diversion from high perm and water/gas zones, to maximize their injection rate (such as to optimize Damkohler numbers and fluid residence times in each layer), and their compatibility (such as ensuring correct sequence and optimal composition of fluids in each layer).

Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A method comprising:

(a) providing a well intervention tool comprising a straddle sealing assembly having upper and lower annulus sealing elements and a fluid injection port positioned therebetween;

(b) placing the intervention tool in straddle position about a wellbore region in a reservoir to be intervened, with a pressure measurement tool fluidly connected to a wellbore region below the lower annulus sealing element; and (c) performing the wellbore intervention operation while communicating fluid from below the lower annulus sealing element to the pressure measurement tool, thus measuring pressure below the lower annulus sealing element during the wellbore intervention operation to determine if a leak across the lower annulus sealing element has occurred.

2. The method of claim 1 further comprising monitoring the movement of a treating fluid or other fluid in the wellbore by the pressure measurement.

3. The method of claim 2 comprising providing one or more sensors in the wellbore for measurement of parameters selected from temperature, salinity, resistivity, optical properties, differential flow, Hall effect, volume of fluid pumped, fluid path, acidity (pH), fluid composition, conductance, resistance, turbidity, color, viscosity, specific gravity, density, and combinations thereof.

4. The method of claim 3 comprising attaching the one or more sensors on or in the pressure measurement tool prior to performing the well intervention.

5. The method of claim 1 wherein the performing a wellbore intervention comprises injecting a fluid selected from inert fluids and reactive fluids.

6. The method of claim 1 wherein performing the wellbore intervention operation comprises injecting a fluid and adjusting a parameter selected from fluid pressure, fluid injection flow rate, fluid temperature, and fluid composition in response to the pressure measurement.

7. The method of claim 6 wherein the adjusting a parameter is made in real time.

8. The method of claim 7 comprising attaching the well intervention tool to an end of coiled tubing, wherein the placing of the well intervention tool in straddle position comprises injecting the coiled tubing into the wellbore, and the injecting of fluid comprises injecting the fluid through the coiled tubing, through the bore of the well intervention tool, and around the pressure measurement tool.

9. The method of claim 8 further comprising analyzing the pressure measurement to determine if a leak of the injected fluid past the lower annulus sealing element has occurred.

10. The method of claim 6 comprising controlling the injection of the fluid via one or more flow control devices or fluid hydraulic techniques to divert or place the fluid into a desired location that is determined by objectives of the well intervention operation.

11. The method of claim 1 comprising attaching the well intervention tool to an end of sectioned pipe wherein the sections are joined by joints selected from welded joints, screwed joints, flanged joints, and combinations thereof.

12. The method of claim 6 comprising steps selected from evaluating, modifying, and programming the well intervention in realtime to ensure an injected treatment fluid is efficiently diverted in the reservoir.

13. The method of claim 6 comprising measuring time of arrival of the injected fluid at the pressure measurement tool.

14. A method comprising:

(a) providing a well intervention tool comprising a straddle sealing assembly having upper and lower annulus sealing elements and a fluid injection port positioned therebetween, the well intervention tool comprising a fluid injection bore;

(b) attaching the intervention tool to an end of coiled tubing and placing the intervention tool in straddle position about a wellbore region in a reservoir to be intervened, with a pressure measurement tool fluidly connected to a wellbore region below the lower annulus sealing element; and (c) injecting a fluid through the coiled tubing, through the well intervention tool, and into the region being intervened;

(d) measuring fluid pressure below the lower annulus sealing element using the pressure measuring tool while injecting the fluid to determine if a leak across the lower annulus sealing element has occurred; and (e) adjusting a parameter selected from fluid pressure, fluid injection flow rate, fluid temperature, and fluid composition in response to the measured fluid pressure.

15. An apparatus comprising:

(a) a straddle sealing assembly comprising upper and lower annulus sealing elements supported by a body, the body comprising i) a longitudinal fluid injection bore having positioned therein a pressure measurement tool, and ii) a fluid injection port positioned in the body between the sealing elements; and (b) a fluid connection connecting the pressure measurement tool fluidly with a wellbore region below the lower annulus sealing element, thus allowing obtaining of a pressure measurement of wellbore fluids below the lower annulus sealing element during a wellbore intervention operation to determine if a leak across the lower annulus sealing element has occurred.

16. The apparatus of claim 15 comprising one or more sensors in the wellbore for measurement of parameters selected from fluid composition, temperature, salinity, resistivity, optical properties, differential flow, Hall effect, volume of fluid pumped, fluid path, acidity (pH), fluid composition, conductance, resistance, turbidity, color, viscosity, specific gravity, density, and combinations thereof.

17. The apparatus of claim 15 wherein an end of the body is attached to an end of an oilfield tubular.

18. The apparatus of claim 17 wherein the oilfield tubular is selected from coiled tubing and sectioned pipe wherein the sectioned pipe comprises welded sections, screwed sections, flanged sections, and combinations thereof.

19. The apparatus of claim 15 wherein the fluid connection connecting the pressure measurement tool fluidly with a wellbore region below the lower annulus sealing element is a single conduit comprising one or more ports to the wellbore region below the lower annulus sealing element.

20. The apparatus of claim 15 wherein the fluid connection connecting the pressure measurement tool fluidly with a wellbore region below the lower annulus sealing element comprises a plurality of conduits each comprising a corresponding port to the wellbore region below the lower annulus sealing element.

21. The method of claim 1 further comprising adjusting the performance of the wellbore intervention operation in response to the pressure measurement.

22. The method of claim 1 wherein performing the wellbore intervention operation comprises injecting a fluid and wherein the method further comprises analyzing the pressure measurement to determine if a leak of the injected fluid past the lower annulus sealing element has occurred.

23. The method of claim 1 wherein the wellbore intervention operation is a stimulation operation.

24. The method of claim 23 wherein the stimulation operation is a fracturing operation.

25. The method of claim 23 wherein the stimulation operation is a matrix acidizing operation.

* * * * *